US010057670B2

(12) United States Patent
Slotte et al.

(10) Patent No.: US 10,057,670 B2
(45) **Date of Patent: *Aug. 21, 2018**

(54) APPARATUS AND METHOD FOR PROVIDING AN APPARATUS COMPRISING AN AUDIO TRANSDUCER

(71) Applicant: Nokia Technologies Oy, Espoo (FI)

(72) Inventors: Benedict Slotte, Turku (FI); Reino Hermann Jaakkola, Ylinen (FI); Antti Kangasaho, Tampere (FI)

(73) Assignee: Nokia Technologies Oy, Espoo (FI)

( * ) Notice: Subject to any disclaimer, the term of this patent is extended or adjusted under 35 U.S.C. 154(b) by 0 days.

This patent is subject to a terminal disclaimer.

(21) Appl. No.: 15/583,129

(22) Filed: May 1, 2017

(65) Prior Publication Data

US 2017/0238077 A1 Aug. 17, 2017

Related U.S. Application Data

(63) Continuation of application No. 14/719,773, filed on May 22, 2015, now Pat. No. 9,641,922.

(30) Foreign Application Priority Data

Jun. 5, 2014 (GB) ..... 1409952.7

(51) Int. Cl.

| | |
|---|---|
| ***H04R 9/08*** | (2006.01) |
| ***H04R 11/04*** | (2006.01) |
| ***H04R 17/02*** | (2006.01) |
| ***H04R 1/02*** | (2006.01) |
| ***H04R 1/08*** | (2006.01) |
| ***H04R 1/04*** | (2006.01) |

(52) U.S. Cl.
CPC ..... *H04R 1/025* (2013.01); *H04R 1/04* (2013.01); *H04R 1/086* (2013.01); *H04R 2410/07* (2013.01); *H04R 2499/11* (2013.01)

(58) Field of Classification Search
CPC ..... H04R 1/025; H04R 1/04; H04R 1/086
See application file for complete search history.

(56) References Cited

U.S. PATENT DOCUMENTS

| | | | |
|---|---|---|---|
| 6,108,416 | A | 8/2000 | Collin et al. |
| 6,421,547 | B1 | 7/2002 | Frohlund et al. |

(Continued)

FOREIGN PATENT DOCUMENTS

| | | | |
|---|---|---|---|
| CN | 201150132 | Y | 11/2008 |
| DE | 4229450 | C1 | 12/1993 |

(Continued)

OTHER PUBLICATIONS

U.S. Appl. No. 14/566,619, "An Apparatus and Method for Providing an Apparatus Comprising a Covering Portion for an Electronic Device", filed Dec. 10, 2014, 26 pages.

*Primary Examiner* — Simon King
(74) *Attorney, Agent, or Firm* — Harrington & Smith

(57) ABSTRACT

An apparatus and method wherein the apparatus comprises: a covering portion configured to cover at least part of an electronic device; and an audio transducer; and a flexible portion comprising at least one conductive trace wherein the flexible portion is configured to connect the audio transducer to the covering portion and the at least one conductive trace is configured to electrically connect the audio transducer to circuitry within the electronic device.

20 Claims, 3 Drawing Sheets

(56) References Cited

U.S. PATENT DOCUMENTS

| | | | | |
|---|---|---|---|---|
| 2006/0140433 | A1* | 6/2006 | Castaneda | H04M 1/021 381/372 |
| 2007/0242848 | A1 | 10/2007 | Yang | 381/386 |
| 2008/0112585 | A1 | 5/2008 | Izuchi et al. | |
| 2009/0245565 | A1 | 10/2009 | Mittleman et al. | |
| 2014/0065851 | A1 | 3/2014 | Gilbert | 439/67 |
| 2014/0090769 | A1* | 4/2014 | Ely | H05K 5/062 156/83 |
| 2014/0093095 | A1 | 4/2014 | Slotte et al. | |
| 2014/0140533 | A1* | 5/2014 | Malek | H04R 1/086 381/91 |
| 2015/0070840 | A1* | 3/2015 | Rappoport | G06F 1/1633 361/679.56 |
| 2017/0213665 | A1* | 7/2017 | Weber | H01H 13/14 |

FOREIGN PATENT DOCUMENTS

| | | | |
|---|---|---|---|
| EP | 1075126 | A2 | 2/2001 |
| EP | 1489879 | A2 | 12/2004 |
| EP | 1670219 | A1 | 6/2006 |
| WO | WO-2007/123300 | A1 | 11/2007 |
| WO | WO-2009/136498 | A1 | 11/2009 |

* cited by examiner

APPARATUS AND METHOD FOR PROVIDING AN APPARATUS COMPRISING AN AUDIO TRANSDUCER

CROSS REFERENCE TO RELATED APPLICATION

This is a continuation patent application of U.S. patent application Ser. No. 14/719,773 filed on May 22, 2015.

TECHNOLOGICAL FIELD

Examples of the disclosure relate to an apparatus and method for providing an apparatus comprising an audio transducer. In particular, they relate to an apparatus and method for providing an apparatus comprising an audio transducer within an electronic device.

BACKGROUND

Electronic devices which comprise an audio transducer are known. For example mobile telephones or tablet computers or other devices may comprise one or more microphones and loudspeakers. The microphones and loudspeakers may be positioned inside the electronic device. In order to allow sound to pass between the audio transducer and the user the housing of the electronic device must have a sound aperture which allows acoustic pressure waves to be conducted between the audio transducer and the external user or sound source. The sound aperture requires one or more holes to be provided in the housing of the electronic device. Where the audio transducer comprises a microphone the holes must be acoustically coupled to the surface of the microphone so that the sound which passes through the holes is incident on the surface of the microphone. Where the audio transducer comprises a loudspeaker the holes must be acoustically coupled to the loudspeaker so that the sound generated by the loudspeaker is audible. This limits the design freedom for the sound aperture.

BRIEF SUMMARY

According to various, but not necessarily all examples of the disclosure, there may be provided an apparatus comprising: a covering portion configured to cover at least part of an electronic device; and an audio transducer; and a flexible portion comprising at least one conductive trace wherein the flexible portion is configured to connect the audio transducer to the covering portion and the at least one conductive trace is configured to electrically connect the audio transducer to circuitry within the electronic device.

In some examples the covering portion comprises a sound aperture and the flexible portion may be positioned between the audio transducer and the sound aperture to seal an end of the sound aperture. The sound aperture may comprise a plurality of holes in the covering portion. The plurality of holes may be distributed over an area of the covering portion wherein the area of the covering portion is larger than a surface area of the audio transducer.

In some examples the sound aperture may comprise a recessed portion within the covering portion configured to allow acoustic pressure waves to travel between the audio transducer and the plurality of holes.

In some examples the flexible portion may be fixed to the covering portion by at least one of adhesive, soldering, welding.

In some examples the at least one conductive trace of the flexible portion may enable the audio transducer to be electrically connected to a circuit board.

In some examples the flexible portion may comprise a flex connector.

In some examples the covering portion may be configured to provide at least part of a housing of an electronic device.

In some examples the audio transducer may comprise a microphone. The microphone may comprise at least one of a digital microphone, an analogue microphone.

In some examples the audio transducer may comprise a loudspeaker.

According to various, but not necessarily all examples of the disclosure, there may be provided an electronic device comprising an apparatus as described above.

According to various, but not necessarily all examples of the disclosure, there may be provided an method comprising: providing a covering portion configured to cover at least part of an electronic device; and providing an audio transducer; and providing a flexible portion comprising at least one conductive trace wherein the flexible portion is configured to connect the audio transducer to the covering portion and the at least one conductive trace is configured to electrically connect the audio transducer to circuitry within the electronic device.

In some examples the method may further comprise providing a sound aperture within the covering portion and positioning the flexible portion between the audio transducer and the sound aperture to seal an end of the sound aperture. The sound aperture may comprise a plurality of holes in the covering portion. The plurality of holes may be distributed over an area of the covering portion wherein the area of the covering portion is larger than a surface area of the audio transducer.

In some examples the sound aperture may comprise a recessed portion within the covering portion configured to allow acoustic pressure waves to travel between the audio transducer and from the plurality of holes.

In some examples the flexible portion may be fixed to the covering portion by at least one of adhesive, soldering, welding.

In some examples the at least one conductive trace of the flexible portion may enable the audio transducer to be electrically connected to a circuit board.

In some examples the flexible portion may comprise a flex connector.

In some examples the covering portion may be configured to provide at least part of a housing of an electronic device.

In some examples the audio transducer may comprise a microphone. The microphone may comprise at least one a digital microphone, an analogue microphone.

In some examples the audio transducer may comprise a loudspeaker.

According to various, but not necessarily all, examples of the disclosure there may be provided examples as claimed in the appended claims.

BRIEF DESCRIPTION

For a better understanding of various examples that are useful for understanding the brief description, reference will now be made by way of example only to the accompanying drawings in which.

DETAILED DESCRIPTION

Figure 1:
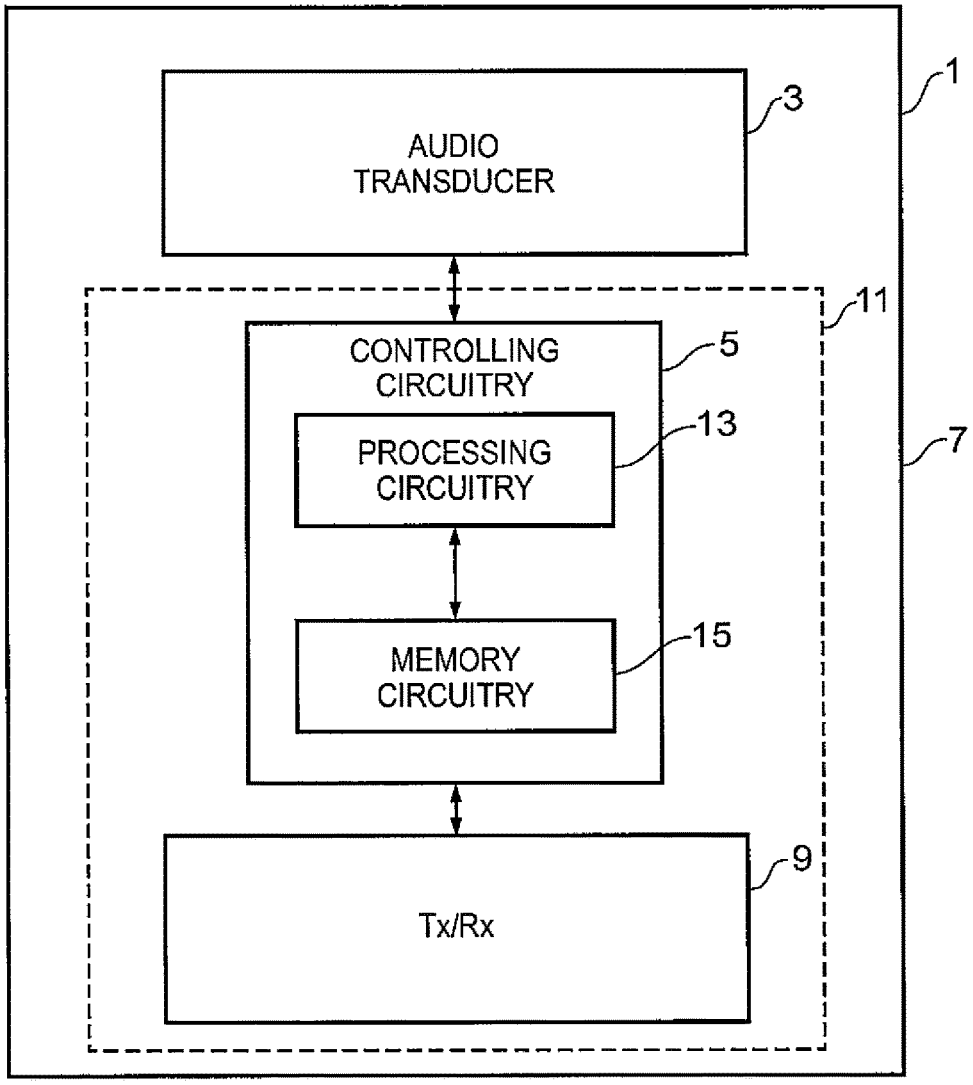
FIG. 1 illustrates an electronic device.

The Figures illustrate an apparatus 21 comprising a covering portion 23 configured to cover at least part of an electronic device 1; and an audio transducer 3; and a flexible portion 25 comprising at least one conductive trace 27 wherein the flexible portion 25 is configured to connect the audio transducer 3 to the covering portion 23 and the at least one conductive trace 27 is configured to electrically connect the audio transducer 3 to circuitry 5 within the electronic device 1.

The flexible portion 25 of the apparatus 21 may enable an audio transducer 3 such as a microphone or a loudspeaker to be connected to the covering portion 23 of the electronic device 1. The flexible portion 25 may also enable the microphone 3 to be electrically connected to circuitry 5 within the electronic device 1. In some examples the flexible portion 25 may also be arranged to seal a sound aperture within the covering portion 23. As the flexible portion 25 performs a plurality of functions this may reduce the number of components within the electronic device. Also the flexible portion 25 may be used to hold the audio transducer 3 securely in position and may enable greater design freedom in the holes on the surface of the covering portion 23.

FIG. 1 schematically illustrates an electronic device 1. The example electronic device of FIG. 1 may comprise an apparatus 21 according to examples of the disclosure. The electronic device 1 may be for example, a mobile cellular telephone, a personal computer, a voice recorder or any other device which may be configured to sense audio inputs such as a user speaking or background noise. The electronic device 1 may be a portable apparatus 1 which can be carried by the user, for example, in a user's hand or bag. The electronic device 1 may be a hand held device that is sized and shaped so that the user can hold the electronic device 1 in their hand while they are using the electronic device 1.

Only features referred to in the following description are illustrated in FIG. 1. However, it should be understood that the electronic device 1 may comprise additional features that are not illustrated. For example the electronic device 1 could also comprise a loudspeaker which may enable audio outputs to be provided.

The example electronic device 1 of FIG. 1 comprises microphone audio transducer 3, controlling circuitry 5 and a housing 7. In some examples the electronic device 1 may also comprise one or more transceivers 9 and a circuit board 11.

The housing 7 provides an external housing for the electronic device 1. When the user is holding or using the electronic device 1 they may touch the housing 7. The components of the electronic device 1, which are illustrated schematically in FIG. 1, may be contained within the housing 7. The housing 7 may provide protection for the components of the electronic device 1. For example, the housing 7 may protect the components of the electronic device 1 from atmospheric conditions such as moisture or temperature variations. The housing 7 may also be configured to protect the components of the electronic device 1 from impact forces.

The housing 7 may comprise one or more covering portions 23. A covering portion 23 may be any part of the housing 7 which covers electronic components within the electronic device 1. For example a housing 7 may comprise a first covering portion 23 which may be configured to cover the front face of the electronic device 1 and a second covering portion 23 which may be configured to cover a rear face of the electronic device 1. In some examples one or more of the covering portions 23 may be configured to be removably attached to the electronic device 1. This may enable a user to remove the covering portion 23 to access internal components of the electronic device 1, for example, to remove a battery or to add or remove a memory card or for any other reason.

The controlling circuitry 5 may be configured to control the electronic device 1. The controlling circuitry 5 may be configured to control the components of the electronic device 1 such as the audio transducer 3 and the transceiver 9 and any other components.

The controlling circuitry 5 may be configured to control the electronic device 1 to perform a plurality of different functions. For example, where the electronic device 1 is configured for wireless communications the controlling circuitry 5 may be configured to control the electronic device 1 to perform functions such as sending and receiving information.

In the example of FIG. 1 the controlling circuitry 5 comprises processing circuitry 13 and memory circuitry 15. The processing circuitry 13 may be configured to read from and write to the memory circuitry 15. The processing circuitry 13 may also comprise an output interface via which data and/or commands are output by the processing circuitry 13 and an input interface via which data and/or commands are input to the processing circuitry 13.

The electronic device 1 illustrated in FIG. 1 also comprises one or more transceivers 9. The transceivers 9 may comprise any means that enables the electronic device 1 to send data to and receive data from other devices. The transceiver 9 may be configured to enable wireless communication. For example the transceiver 9 may be configured to enable the electronic device 1 to operate in a cellular communications network.

In the example illustrated in FIG. 1 the transceiver 9 has been illustrated as a single entity. It is to be appreciated that the transceiver 9 may comprise a separate transmitter and receiver. It is also to be appreciated that more than one transmitter and more than one receiver may be provided within a single electronic device 1.

The one or more transceivers 9 may be configured to receive input signals from the controlling circuitry 5 and also to provide output signals to the controlling circuitry 5.

The controlling circuitry 5 may be mounted on a circuit board 11. In some examples some of the one or more transceivers 9 may also be mounted on a circuit board 11 as indicated by the dashed line.

The circuit board 11 may comprise any means which may be configured to support one or more electronic components and enable the electronic components to be electrically connected. The circuit board 11 may be a printed circuit board (PCB) a flexible circuit board or any other suitable type of circuit board. It is to be appreciated that in some examples the electronic device 1 may comprise more than one circuit board. The circuit board 11 may comprise one or more conductive traces which may enable the electronic components to be connected together.

The audio transducer 3 may comprise any means which may be configured to convert an acoustic pressure wave to an electric signal or to convert an electric signal to an acoustic pressure wave. For example the audio transducer 3 may comprise a microphone or a loudspeaker.

The microphone may comprise any means which may be configured to detect an audio input signal and convert the detected audio input signal to an electrical output signal. The microphone may be electrically connected to the controlling circuitry 5. The microphone may be configured to receive input signals from the controlling circuitry 5 and also to provide output signals to the controlling circuitry 5.

In some examples the microphone may comprise a digital microphone. In some examples the microphone may comprise an analogue microphone.

The microphone may be an electret condenser microphone (ECM), a micro electro mechanical system (MEMS) microphone or any other suitable type of microphone. The microphone may be incorporated in a casing that has one or more sound ports for receiving acoustic pressure waves. The examples of this disclosure may be implemented by using microphones, including but not limited to ECM or MEMS microphones.

The loudspeaker may comprise any means which may be configured to receive an electrical input signal and convert the received electrical input signal into an audio output signal. The loudspeaker may be electrically connected to the controlling circuitry 5. The loudspeaker may be configured to receive input signals from the controlling circuitry 5 and also to provide output signals to the controlling circuitry 5.

In the example of FIG. 1 only one audio transducer 3 is illustrated. It is to be appreciated that in other examples the electronic device 1 may comprise more than one audio transducer 3. For example, where the electronic device 1 is a mobile telephone the electronic device may comprise at a microphone and a loudspeaker. In some examples the electronic device 1 may comprise more than one microphone and/or more than one loudspeaker. For example, a first microphone may be positioned adjacent to the front covering portion 23 of the electronic device 1. The first microphone may be arranged to detect the user's voice when they are making a telephone call. A second microphone may be positioned adjacent to the rear covering portion 23 of the electronic device 1. The second microphone may be arranged to detect ambient sounds to enable active noise cancellation.

The audio transducer 3 may be provided as part of an audio transducer assembly. The audio transducer assembly may be a module comprising a microphone and/or loudspeaker which can be connected to other electronic components within the electronic device 1. The audio transducer assembly may comprise electrical contacts which may enable electrical connections to be established between the audio transducer 3 and one or more conductive traces 27. In some examples the audio transducer assembly may also comprise other components such as an acoustic conduit which may be configured to conduct sound between the audio transducer 3 and a sound aperture in the covering portion 23. The audio transducer assembly may be a top port assembly or a bottom port assembly. The top port assembly may have contact pads on the same side as the audio transducer 3 while a bottom port assembly may have contact pads on an opposite side to the audio transducer 3.

Figure 2:
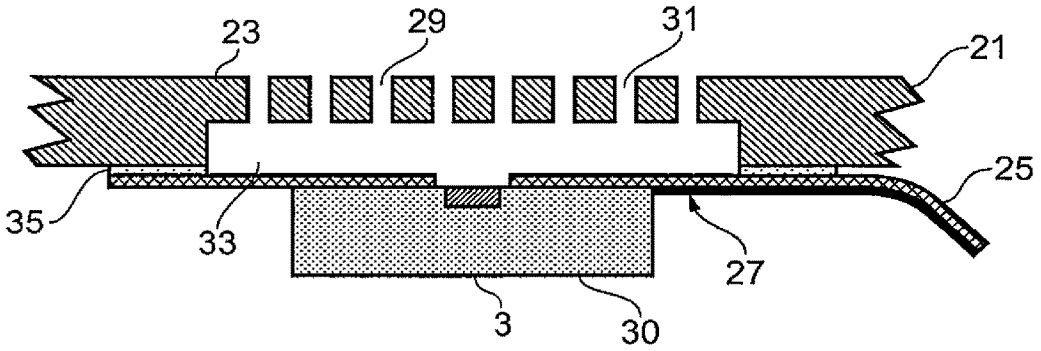
FIG. 2 illustrates an apparatus.
Figure 3:
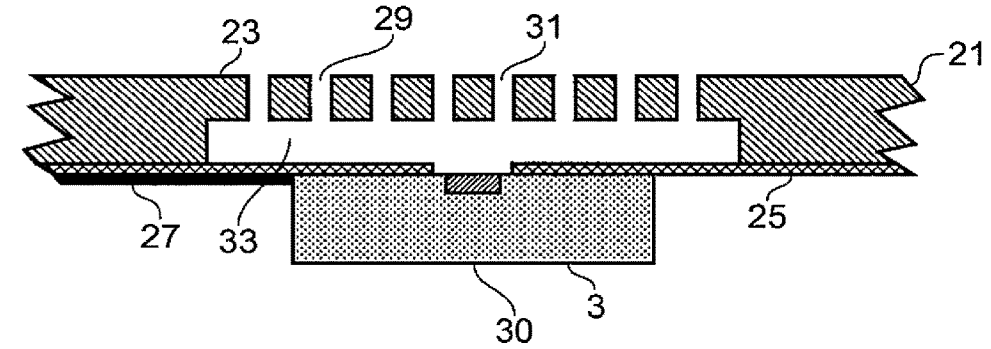
FIG. 3 illustrates an apparatus.
Figure 4:
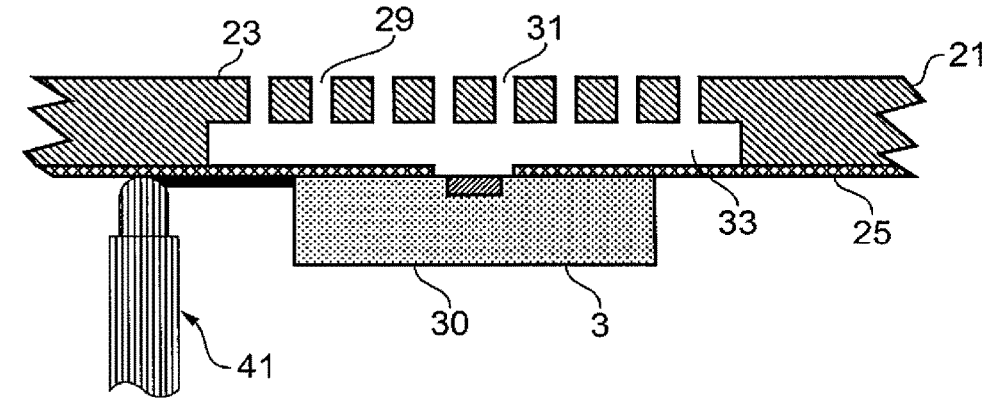
FIG. 4 illustrates an apparatus.

In examples of the disclosure the audio transducer 3 may be connected to a covering portion 23 of the electronic device 1. In such examples the covering portion 23 may support the weight of the audio transducer 3 and/or audio transducer assembly so that the audio transducer 3 need not be mounted on the circuit board 11. In some examples there may be a gap provided between the audio transducer and the circuit board 11. FIGS. 2 to 4 illustrate example apparatus 21 which enable a microphone 3 to be connected to a covering portion 23.

FIG. 2 illustrates an apparatus 21 according to examples of the disclosure. FIG. 2 illustrates a cross section through the apparatus 21. The example apparatus 21 comprises an audio transducer 3, a covering portion 23 and a flexible portion 25. The apparatus 21 may be comprised within an electronic device 1 such as the example device of FIG. 1. In the example of FIG. 2 the audio transducer 3 comprises a microphone 30. It is to be appreciated that in other examples the audio transducer 3 may comprise a loudspeaker.

Only features referred to in the following description are illustrated in FIG. 2. However, it should be understood that additional features that are not illustrated may also be provided. For example the electronic device 1 may also comprise circuitry and a circuit board 11 as described above in relation to FIG. 1. The apparatus 1 may also comprise a dust mesh between the microphone 30 and the sound aperture 29. The dust mesh may be configured to protect the microphone 30 from dust and other small particles.

The covering portion 23 may be part of the housing 7 of the electronic device 1. The covering portion 23 may be part of the front face or the rear face of the housing 7 or any other part of the housing 7. The covering portion 23 may be made from a rigid plastic or any other suitable material.

In some examples the covering portion 23 may comprise a grill or mesh structure which may be provided within the housing 7. The grill or mesh structure may comprise a separate component which may be attached to the housing 7. For example, the housing 7 may comprise a window or other hole and the grill or mesh structure may be provided within the window. The grill or mesh structure may be configured to be acoustically transparent so as to enable acoustic pressure waves to pass through the grill or mesh structure. The degree to which the grill or mesh structure is acoustically transparent may be adjusted for the frequency response of the audio transducer 3. The holes within the grill or mesh structure may be very small. The holes within the grill or mesh structure may be regular or irregular in shape and/or order.

The covering portion 23 comprises a sound aperture 29. The sound aperture 29 may comprise any means which may enable acoustic pressure waves to travel between the audio transducer 3 and the outside of the electronic device. In the example of FIG. 2 the sound aperture 29 may comprise any means which may enable acoustic pressure waves from outside of the electronic device 1 to be provided to the microphone 30 on the inside of the electronic device 1. In the example of FIG. 2 the sound aperture 29 comprises a plurality of holes 31 and a recessed portion 33 within the covering portion 23. The microphone 30 is positioned adjacent to the recessed portion 33 of the sound aperture 29.

The plurality of holes 31 are provided in the surface of the covering portion 23. The plurality of holes 31 may be distributed over an area of the surface of the covering portion 23. The plurality of holes 31 may be arranged in any suitable configuration. Each of the plurality of holes 31 may have a surface area which is much smaller than the surface area of the microphone 30. However the area over which the plurality of holes 31 is distributed may be much larger than the surface area of the microphone 30. This may provide for greater design freedom in the arrangement of the holes 31. This may also reduce wind noise and other interference which may affect the microphones 30. As an example the diameters of the holes 31 may be between 0.05 and 0.1 mm and the plurality of holes 31 may be spread over an area of diameter 2-3 mm and the holes may be approximately 0.15 mm apart. Other dimensions may be used in other examples of the disclosure.

The recessed portion 33 of the covering portion comprises a region of the covering portion 23 which is thinner than the rest of the covering portion 23. For example the thickness of the covering portion 23 could be 0.8 mm for most of the covering portion 23 but in the recessed region the thickness could be 0.4 mm. It is to be appreciated that other thicknesses could be used in other examples of the disclosure.

The recessed portion 33 may be aligned with the plurality of holes 31. The position of the recessed portion 33 may be aligned with the surface area of the covering portion 23 over which the plurality of holes 31 are distributed so that the recessed portion 33 is provided underneath the holes 31. The recessed portion 33 and the plurality of holes 31 form a channel though which acoustic pressure waves from outside the covering portion 23 can be transmitted to the microphone 30 on the inside of the covering portion.

The flexible portion 25 may be positioned between the audio transducer 3 and the sound aperture 29 so that an end of the sound aperture 29 may be sealed by the flexible portion 25. The flexible portion 25 may be arranged to cover the recessed portion 33 on the inside of the electronic device 1. The flexible portion 25 may be configured to provide a seal around the edge of the recessed portion 33.

The flexible portion 25 may comprise a portion of flexible material. The flexible material may be thin. The thickness of the flexible material may be much less than the thickness of the covering portion 23. For example, where the covering portion has a thickness of 0.8 mm the flexible material may have a thickness of less than 0.2 mm. The flexible portion may be made of any suitable material.

The flexible portion 25 may be connected to the covering portion 23. In the example of FIG. 2 the flexible portion 23 is connected the covering portion 23 by an adhesive 35. The flexible portion 23 and the adhesive 35 may provide an acoustic seal around the edge of the recessed portion 33.

The flexible portion 25 may also be configured to connect the audio transducer 3 to the covering portion 23. The audio transducer 3 may be connected to the flexible portion 25 using any suitable means. For example the audio transducer 3 may be adhered or welded or soldered to the flexible portion 25. In some examples the audio transducer 3 and the flexible portion 25 may be formed together so that the audio transducer 3 is integrated into the flexible portion 25.

The microphone 30 of FIG. 2 may be as described above in relation to FIG. 1. The microphone 30 is positioned adjacent to the sound aperture 29 so that acoustic pressure waves which pass though the sound aperture 29 are incident on the microphone 30.

The flexible portion 25 may also comprise one or more conductive traces 27. The conductive traces 27 may be configured to enable the audio transducer 3 to be connected to circuitry 5 within the electronic device 1. The conductive traces 27 may provide a path for direct current between the audio transducer 3 and the circuitry 5. For example, in some implementations the flexible portion 25 may comprise a flex connector which may comprise a plurality of electrical connections which can be connected to the audio transducer 3. The conductive traces 27 may comprise any suitable conductive material. In some implementations the flexible portion 25 may comprise one or more conductive traces that are not connected to the audio transducer 3, for example an antenna.

Only one end of the flexible portion 25 is illustrated in FIG. 2. The other end may be connected to the circuit board 11. In the example of FIG. 2 the conductive traces 27 of the flexible portion 25 may be directly connected to the circuit board 11. For instance, they may be welded or otherwise connected to components or contact pads on the circuit board 11.

FIG. 3 illustrates another example apparatus 21 according to another example of the disclosure. The example apparatus of FIG. 3 also comprises a microphone 30, a covering portion 23 and a flexible portion 25 which may be as described above in reference to FIG. 2. Corresponding reference numerals are used for corresponding features.

In the example of FIG. 3 the flexible portion 25 is attached directly to the covering portion 23. For example the flexible portion 25 may be welded or soldered to the covering portion 23 so that there is no intervening adhesive layer between the flexible portion 25 and the covering portion 23. In such examples the flexible portion 25 may provide an acoustic seal for the sound aperture 29.

In the example of FIG. 3 the conductive traces 27 of the flexible portion 25 may be directly connected to the circuit board 11.

FIG. 4 illustrates another example apparatus 21 according to another example of the disclosure. The example apparatus of FIG. 4 also comprises a microphone 30, a covering portion 23 and a flexible portion 25 which may be as described above in reference to FIGS. 2 and 3. Corresponding reference numerals are used for corresponding features.

In the example of FIG. 4 the flexible portion 25 is attached directly to the covering portion 23. In the example of FIG. 4 intervening components may be used to connect the conductive traces 27 to the circuit board 11. In the example of FIG. 4 connectors 41 such as pogo pins are used to connect the conductive traces 27 on the flexible portion 25 to the circuitry 5 on the circuit board 11. This may enable the conductive traces 27 of the flexible portion 25 to be connected to the circuit board 11 without having the conductive traces extend all the way to the circuit board 11.

Figure 5:
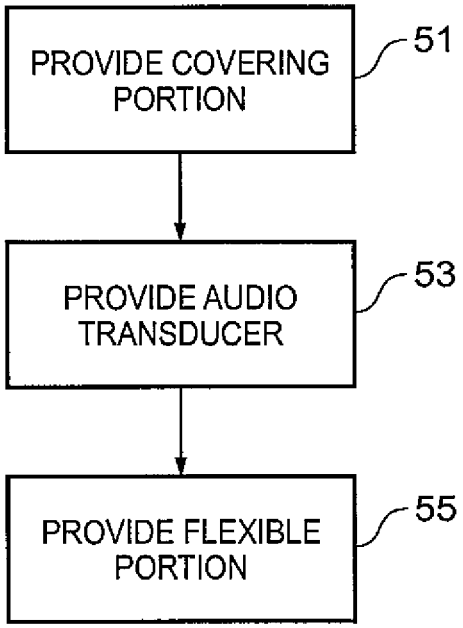
FIG. 5 illustrates a method.

FIG. 5 illustrates an example method. The method may be for providing an apparatus 21 such as the apparatus described above in relation to any of FIGS. 2 to 3. The method comprises, at block 51 providing a covering portion 23. The covering portion 23 may be configured to cover at least part of an electronic device 1. The method may also comprise, at block 53, providing an audio transducer 3.

At block 55 the method comprises providing a flexible portion 25. The flexible portion 23 may comprise at least one conductive trace 25. The flexible portion 25 may be configured to connect the audio transducer 3 to the covering portion 23. The at least one conductive trace 27 may be configured to electrically connect the audio transducer 3 to circuitry 5 within the electronic device 1.

In some examples the holes 31 for the audio inlet may be provided after the audio transducer 3 is attached to the covering portion 23. For example laser drilling, or any other suitable method, may be used to create the plurality of holes 31 after the flexible portion 25 has been connected to the covering portion 23.

Apparatus 21 and methods as described above provide an improved mechanism for connecting an audio transducer 3 such as a microphone 30 or loudspeaker to a covering portion 23 of an electronic device 1.

The flexible portion 25 may be configured to perform a plurality of functions. For example the flexible portion 25 may provide means for connecting the microphone 3 to the covering portion 23, means for sealing the sound aperture 29 and means for providing electrical connections between the audio transducer 3 and the circuit board 11. This may reduce the number of components within the electronic device 1 which may make the electronic device 1 simpler to assemble and may provide space savings within the electronic device 1.

The flexible portion 25 may also be configured to secure the audio transducer 3 in position adjacent to the audio inlet 29 and restrict movement of the audio transducer 3 relative to the audio inlet. As the flexible portion 25 is adhered or welded or otherwise fixed to the covering portion 23 this prevents the flexible portion from moving parallel to the surface of the covering portion 23. As the audio transducer 3 is connected to the flexible portion 25 this also prevents the audio transducer 3 from moving parallel to the surface of the covering portion 23. This ensures that the frequency response of an audio transducer 3, such as a microphone 30, and the sound aperture 29 is not affected by movement of the audio transducer 3. This may be beneficial if other components within the electronic device 1 have larger placement tolerances. Also as the flexible portion 25 may be flexible this reduces the mechanical forces on the audio transducer 3 which may be caused when the electronic device 1 is dropped or subjected to any other mechanical impact. This may help to protect the audio transducer 3.

Examples of the disclosure also allow for the audio transducer 3 to be connected to the covering portion rather than the circuit board 11. This enables the audio transducer 3 to be located close to the sound aperture 29 which may reduce the amount of attenuation and/or leakage of the acoustic input signal.

As the flexible portion 25 acts as a seal for an end of the sound aperture 29 this allows the recessed portion 33 to cover a larger area. This allows the sound aperture 29 to comprise a plurality of smaller holes rather than one large hole. This may provide for a more aesthetically pleasing housing 7 of an electronic device 1. Also the smaller holes 31 may help to attenuate wind noise, or other noises caused by effects such as Helmholtz resonance, than one larger hole.

Also the flexible portion 25 allows for a larger recessed area 33 which enables the plurality of small holes 31 to be distributed over a larger area. This reduces the likelihood of all of the holes being blocked up by dirt and/or grease. This may also enable the holes to be arranged to be aesthetically pleasing.

The flexible portion 25 allows the audio transducer 3 to be connected to the covering portion 23. However, as the audio transducer 3 and covering portion 23 are separate components this allows them to be separated for repair and/or replacement.

The term "comprise" is used in this document with an inclusive not an exclusive meaning. That is any reference to X comprising Y indicates that X may comprise only one Y or may comprise more than one Y. If it is intended to use "comprise" with an exclusive meaning then it will be made clear in the context by referring to "comprising only one . . . " or by using "consisting".

In this detailed description, reference has been made to various examples. The description of features or functions in relation to an example indicates that those features or functions are present in that example. The use of the term "example" or "for example" or "may" in the text denotes, whether explicitly stated or not, that such features or functions are present in at least the described example, whether described as an example or not, and that they can be, but are not necessarily, present in some of or all other examples. Thus "example", "for example" or "may" refers to a particular instance in a class of examples. A property of the instance can be a property of only that instance or a property of the class or a property of a sub-class of the class that includes some but not all of the instances in the class. It is therefore implicitly disclosed that a features described with reference to one example but not with reference to another example, can where possible be used in that other example but does not necessarily have to be used in that other example.

Although embodiments of the present invention have been described in the preceding paragraphs with reference to various examples, it should be appreciated that modifications to the examples given can be made without departing from the scope of the invention as claimed. For instance, in the above described examples a microphone 30 is connected to the covering portion 23 of the electronic device 1. In other examples a loudspeaker or other type of sensor could be connected to the covering portion 23.

In the above described examples the sound aperture 29 comprises a plurality of holes 31. In other examples the sound aperture 29 may comprise a thin protective membrane which may be configured to vibrate to allow acoustic pressure signals to pass through the membrane. In such examples the sound aperture 29 may be airtight but may still allow acoustic signals to pass through.

In the examples of FIGS. 2 to 4 the plurality of holes 31 of the sound aperture 29 are distributed over an area of the covering portion 23 wherein the area of the covering portion 23 is larger than a surface area of the audio transducer 3. In other examples the plurality of holes 31 of the sound aperture 29 may be distributed over an area of the covering portion 23 wherein the area of the covering portion 23 is the within the surface area of the audio transducer 3.

Features described in the preceding description may be used in combinations other than the combinations explicitly described.

Although functions have been described with reference to certain features, those functions may be performable by other features whether described or not.

Although features have been described with reference to certain embodiments, those features may also be present in other embodiments whether described or not.

Whilst endeavoring in the foregoing specification to draw attention to those features of the invention believed to be of particular importance it should be understood that the Applicant claims protection in respect of any patentable feature or combination of features hereinbefore referred to and/or shown in the drawings whether or not particular emphasis has been placed thereon.

The invention claimed is:

1. An electronic device comprising:

a covering portion;

a flexible portion comprising at least one conductive trace; and an audio transducer integral with the flexible portion, wherein the flexible portion is configured to connect the audio transducer to the covering portion and the at least one conductive trace is configured to electrically connect the audio transducer to circuitry within the electronic device;

wherein the covering portion comprises at least one opening configured to couple the audio transducer with the exterior of the electronic device, and wherein the flexible portion is configured to seal around the at least one opening.

2. The electronic device as claimed in claim 1, wherein the covering portion comprises a sound aperture, wherein the sound aperture comprises the at least one opening and a recessed portion, and wherein the flexible portion is configured to seal around an edge of the recessed portion.

3. The electronic device as claimed in claim 2, wherein the thickness of the covering portion is thinner at the region of the recessed portion than the remainder of the covering portion.

4. The electronic device as claimed in claim 2, wherein the sound aperture comprises a plurality of openings, wherein the recessed portion is substantially aligned with the plurality of openings.

5. The electronic device as claimed in claim 4, wherein the sound aperture comprises the recessed portion within the covering portion configured to allow acoustic pressure waves to travel between the audio transducer and the plurality of openings.

6. The electronic device as claimed in claim 1, wherein the at least one conductive trace of the flexible portion enables the audio transducer to be electrically connected to a circuit board.

7. The electronic device as claimed in claim 1, wherein a configuration of the audio transducer and the flexible portion comprises at least one of:

the audio transducer integrated into the flexible portion; and the audio transducer fixedly attached to the flexible portion.

8. The electronic device as claimed in claim 1, wherein the covering portion is configured to provide at least part of a housing of the electronic device.

9. The electronic device as claimed in claim 1, wherein the audio transducer comprises one of: a microphone; and a loudspeaker.

10. The electronic device as claimed in claim 1, wherein the covering portion is configured to cover at least part of the electronic device.

11. An apparatus comprising:

a covering portion comprising a sound aperture;

a flexible portion comprising at least one conductive trace; and an audio transducer, wherein the flexible portion is between the covering portion and the audio transducer, wherein the sound aperture comprises at least one opening and a recessed portion, wherein the flexible portion is configured to seal around an edge of the recessed portion, wherein the flexible portion is configured to connect the audio transducer to the covering portion and the at least one conductive trace is configured to electrically connect the audio transducer to circuitry within an electronic device.

12. The apparatus as claimed in claim 11, wherein a configuration of the audio transducer and the flexible portion comprises at least one of:

the audio transducer integrated into the flexible portion; and the audio transducer fixedly attached to the flexible portion.

13. The apparatus as claimed in claim 11, wherein the thickness of the covering portion is thinner at the region of the recessed portion than the remainder of the covering portion.

14. The apparatus as claimed in claim 11, wherein the sound aperture comprises a plurality of openings, wherein the recessed portion is substantially aligned with the plurality of openings.

15. The apparatus as claimed in claim 11, wherein the recessed portion is configured to allow acoustic pressure waves to travel between the audio transducer and the at least one opening.

16. The apparatus as claimed in claim 11, wherein the at least one conductive trace of the flexible portion enables the audio transducer to be electrically connected to a circuit board.

17. The apparatus as claimed in claim 11, wherein the flexible portion comprises a flex connector.

18. The apparatus as claimed in claim 11, wherein the covering portion is configured to provide at least part of a housing of the electronic device.

19. The apparatus as claimed in claim 11, wherein the audio transducer comprises one of: a microphone; and a loudspeaker.

20. The apparatus as claimed in claim 11, wherein the flexible portion is fixed to the covering portion by at least one of adhesive, soldering, welding.

* * * * *